US006328879B1

(12) United States Patent
Kalnes

(10) Patent No.: US 6,328,879 B1
(45) Date of Patent: Dec. 11, 2001

(54) SIMULTANEOUS HYDROPROCESSSING OF TWO FEEDSTOCKS

(75) Inventor: Tom N. Kalnes, La Grange, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/360,837

(22) Filed: Jul. 26, 1999

(51) Int. Cl.[7] ..... C10G 51/00

(52) U.S. Cl. ..... 208/78; 208/58; 208/61; 208/80

(58) Field of Search ..... 208/58, 78, 80, 208/50, 61

(56) References Cited

U.S. PATENT DOCUMENTS 5,720,872 * 2/1998 Gupta ..... 208/58
5,904,835 * 5/1999 Thakkar ..... 208/97

* cited by examiner

*Primary Examiner*—Helane E. Myers
(74) *Attorney, Agent, or Firm*—John G. Tolomei; John G. Cutts, Jr.

(57) ABSTRACT

A catalytic hydrocracking process wherein a first hydrocarbonaceous feedstock is contacted with a hydrogen and a metal promoted hydrocracking catalyst in a hydrocracking reaction zone at elevated temperature and pressure to obtain conversion to lower boiling hydrocarbons. The resulting hot, uncooled effluent from the hydrocracking reaction zone is hot hydrogen stripped in a stripping zone maintained at essentially the same pressure as the hydrocracking zone to produce a first gaseous hydrocarbonaceous stream and a first liquid hydrocarbonaceous stream. At least a portion of the first liquid hydrocarbonaceous stream is preferably recycled to the hydrocracking reaction zone. A second hydrocarbonaceous feedstock having a boiling temperature range lower than that of the first hydrocarbonaceous feedstock is introduced into an upper end of the stripper to serve as reflux. The first gaseous hydrocarbonaceous stream is removed from the stripper and passed to a post-treat hydrogenation reaction zone to saturate aromatic compounds.

21 Claims, 1 Drawing Sheet

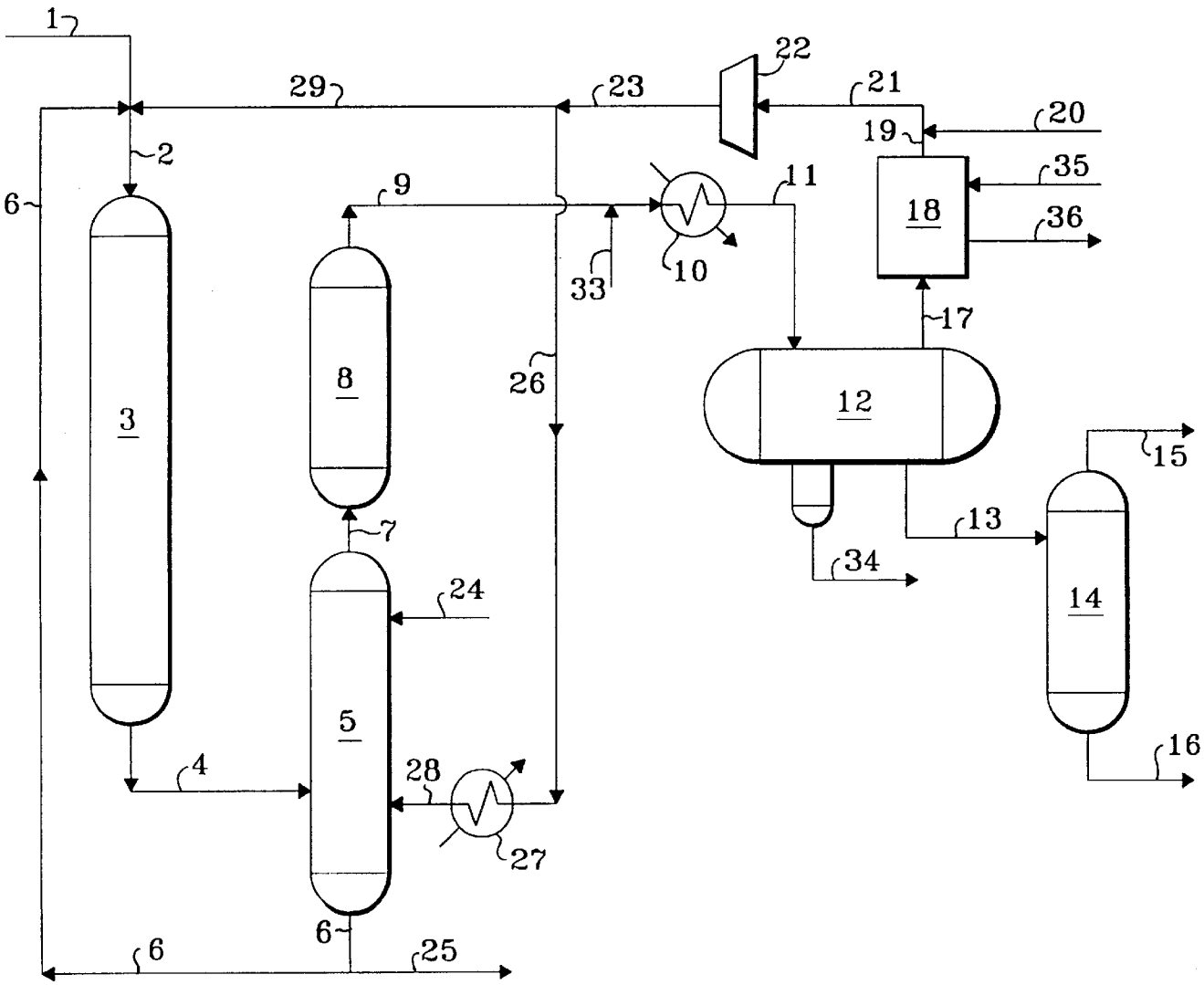
1
2
3
4
5
6
6
7
8
9
10
11
12
13
14
15
16
17
18
19
20
21
22
23
24
25
26
27
28
29
33
34
35
36

SIMULTANEOUS HYDROPROCESSSING OF TWO FEEDSTOCKS

BACKGROUND OF THE INVENTION

The field of art to which this invention pertains is the simultaneous hydroprocessing of two hydrocarbonaceous feedstocks. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oils recovered from crude oil by distillation. A typical heavy gas oil comprises a substantial portion of hydrocarbon components boiling above about 700° F., usually at least about 50 percent by weight boiling above 700° F. A typical vacuum gas oil normally has a boiling point range between about 600° F. and about 1050° F.

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products.

Although a wide variety of process flow schemes, operating conditions and catalysts have been used in commercial activities, there is always a demand for new hydrocracking methods which provide lower costs and higher liquid product yields and quality. It is generally known that enhanced product selectivity can be achieved at lower conversion per pass (60% to 90% conversion of fresh feed) through the catalytic hydrocracking zone. However, it was previously believed that any advantage of operating at below about 60% conversion per pass was negligible or would only see diminishing returns. Low conversion per pass is generally more expensive, however, the present invention greatly improves the economic benefits of a low conversion per pass process and demonstrates the unexpected advantages.

INFORMATION DISCLOSURE

U.S. Pat. No. 5,720,872 discloses a process for hydroprocessing liquid feedstocks in two or more hydroprocessing stages, which are in separate reaction vessels and wherein each reaction stage contains a bed of hydroprocessing catalyst. The liquid product from the first reaction stage is sent to a low pressure stripping stage and stripped of hydrogen sulfide, ammonia and other dissolved gases. The stripped product stream is then sent to the next downstream reaction stage, the product from which is also stripped of dissolved gases and sent to the next downstream reaction stage until the last reaction stage, the liquid product of which is stripped of dissolved gases and collected or passed on for further processing. The flow of treat gas is in a direction opposite the direction in which the reaction stages are staged for the flow of liquid. Each stripping stage is a separate stage, but all stages are contained in the same stripper vessel.

International Publication No. WO 97/38066 (PCT/US 97/04270) discloses a process for reverse staging in hydroprocessing reactor systems.

U.S. Pat. No. 3,328,290 (Hengstebech) discloses a two-stage process for the hydrocracking of hydrocarbons in which the feed is pretreated in the first stage.

U.S. Pat. No. 5,114,562 (Haun et al) discloses a process wherein a middle distillate petroleum stream is hydrotreated to produce a low sulfur and low aromatic product employing two reaction zones in series. The effluent from the first reaction zone (desulfurization) is cooled and introduced into a hydrogen stripping zone wherein hydrogen sulfide is removed overhead along with a small amount of hydrocarbons which were in the vapor at conditions present at the top of the stripping zone. The bottom stream from the stripping zone is reheated and introduced into the second reaction zone (aromatic saturation) containing sulfur-sensitive noble metal hydrogenation catalyst. The operating pressure increases and the temperature decreases from the first to the second reaction zones. The desulfurization conditions employed are relatively moderate as only a very limited amount of cracking is desired. It is totally undesired to perform any significant cracking within the second reaction zone. It is specifically desired to minimize the content of heavy product distillate hydrocarbons such as diesel fuel in the vapor phase of the stripping zone.

BRIEF SUMMARY OF THE INVENTION

The present invention is a catalytic hydrocracking process which simultaneously hydroprocesses two feedstocks to provide higher liquid product yields and increase the quality of the liquid products. The process of the present invention provides the yield advantages associated with a low conversion per pass operation without compromising unit economics. In addition, lower capital costs will be realized with the use of the present invention.

In the present invention, a first hydrocarbonaceous feedstock and hydrogen are passed to a hydrocracking reaction zone to produce a stream containing lower boiling hydrocarbonaceous compounds which stream is in turn passed to a hot, high pressure stripper utilizing a hot, hydrogen-rich stripping gas to produce a vapor stream containing hydrogen and hydrocarbonaceous compounds boiling at a temperature below the first feedstock and a liquid stream containing hydrocarbonaceous compounds boiling in the range of the first feedstock. A second hydrocarbonaceous feedstock having a boiling temperature range lower than the first hydrocarbonaceous feedstock is passed into an upper end of the stripper to serve as reflux. The vapor stream containing hydrogen and hydrocarbonaceous compounds boiling at a temperature below the first feedstock is introduced into a post-treat hydrogenation reaction zone to saturate at least a portion of the aromatic compounds contained therein. At least a portion of the second feedstock is vaporized in the stripper and passes into the post-treat hydrogenation reaction zone to saturate aromatic compounds and thereby improve the quality of the hydrocarbonaceous effluent from the post-treat zone. At least a portion of the effluent from the post-treat hydrogenation reaction zone is condensed to produce a second liquid stream containing hydrocarbonaceous compounds boiling at a temperature below the first feedstock and a second vapor stream containing hydrogen and hydrogen sulfide. In a preferred embodiment, at least a portion of the hydrogen sulfide is removed from the second vapor stream before it is recycled to the hydrocracking zone.

In accordance with one embodiment the present invention relates to a process for the simultaneous hydroprocessing of two feedstocks having different boiling ranges which process comprises: (a) passing a first hydrocarbonaceous feedstock and hydrogen to a hydrocracking zone containing a hydrocracking catalyst and operating at a temperature of about 400° F. to about 900° F., a pressure from about 500 psig to about 2500 psig, a liquid hourly space velocity from about 0.1 $hr^{-1}$ to about 15 $hr^{-1}$ and recovering a hydrocracking zone effluent therefrom; (b) passing the hydrocracking zone effluent directly to a hot, high pressure stripper utilizing a hot, hydrogen-rich stripping gas to produce a first vapor stream comprising hydrogen, hydrogen sulfide and hydrocarbonaceous compounds boiling at a temperature below the first hydrocarbonaceous feedstock, and a first liquid stream comprising hydrocarbonaceous compounds boiling in the range of the first hydrocarbonaceous feedstock; (c) passing a second hydrocarbonaceous feedstock having a boiling temperature range lower than that of the first hydrocarbonaceous feedstock into an upper end of the stripper to serve as reflux; (d) passing at least a portion of the first vapor stream recovered in step (b) to a post-treat hydrogenation reaction zone to saturate aromatic compounds; (e) condensing at least a portion of the resulting effluent from the post-treat hydrogenation reaction zone to produce a second liquid stream comprising hydrocarbonaceous compounds boiling at a temperature below the first hydrocarbonaceous feedstock and a second vapor stream comprising hydrogen and hydrogen sulfide; and (f) recycling at least a portion of the second vapor stream to the hydrocracking zone.

In accordance with another embodiment the present invention relates to a process for the simultaneous hydroprocessing of two feedstocks having different boiling ranges which process comprises: (a) passing a first hydrocarbonaceous feedstock and hydrogen to a hydrocracking zone containing a hydrocracking catalyst and operating at a temperature of about 400° F. to about 900° F., a pressure from about 500 psig to about 2500 psig, a liquid hourly space velocity from about 0.1 $hr^{-1}$ to about 15 $hr^{-1}$ and recovering a hydrocracking zone effluent therefrom; (b) passing the hydrocracking zone effluent directly to a hot, high pressure stripper utilizing a hot, hydrogen-rich stripping gas to produce a first vapor stream comprising hydrogen, hydrogen sulfide and hydrocarbonaceous compounds boiling at a temperature below the first hydrocarbonaceous feedstock, and a first liquid stream comprising hydrocarbonaceous compounds boiling in the range of the first hydrocarbonaceous feedstock; (c) passing a second hydrocarbonaceous feedstock having a boiling temperature range lower than that of the first hydrocarbonaceous feedstock into an upper end of the stripper to serve as reflux; (d) passing at least a portion of the first vapor stream recovered in step (b) to a post-treat hydrogenation reaction zone to saturate aromatic compounds; (e) condensing at least a portion of the resulting effluent from the post-treat hydrogenation reaction zone to produce a second liquid stream comprising hydrocarbonaceous compounds boiling at a temperature below the first hydrocarbonaceous feedstock and a second vapor stream comprising hydrogen and hydrogen sulfide; (f) recycling at least a portion of the second vapor stream to the hydrocracking zone; and (g) recycling at least a portion of the first liquid stream to the hydrocracking zone.

Other embodiments of the present invention encompass further details such as types and descriptions of feedstocks, hydrocracking catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not intended to be a limitation thereof.

DETAILED DESCRIPTION OF THE INVENTION

The present invention is particularly useful for hydroprocessing two feedstocks to achieve higher liquid product yields and a lower cost of production. The feedstocks contain hydrocarbons and/or other organic materials to produce a product containing hydrocarbons and/or other organic materials of lower average boiling point and improved product characteristics such as improved cetane and smoke point, and reduced contaminants such as sulfur and nitrogen. The hydrocarbon feedstocks that may be subjected to hydroprocessing by the method of the invention include all mineral oils and synthetic oils (e.g., shale oil, tar sand products, etc.) and fractions thereof. The higher boiling hydrocarbon feedstocks include those containing components boiling above 550° F. such as atmospheric gas oils, vacuum gas oils, deasphalted, vacuum, and atmospheric residua, hydrotreated residual oils, coker distillates, straight run distillates, pyrolysis-derived oils, high boiling synthetic oils and cat cracker distillates. One preferred hydrocracking feedstock is a gas oil or other hydrocarbon fraction having at least 50% by weight and most usually at least 75% by weight, of its components boiling at temperatures above the end point of the desired product, which end point, in the case of heavy gasoline, is generally in the range from about 380° F. to about 420° F. One of the most preferred gas oil feedstocks will contain hydrocarbon components which boil above 550° F. with best results being achieved with feeds containing at least 25 percent by volume of the components boiling between 600° F. and 1000° F. Also included are petroleum distillates wherein at least 90 percent of the components boil in the range from about 300° F. to about 800° F.

The first selected feedstock is first introduced into a hydrocracking reaction zone at hydrocracking reaction conditions. Preferred hydrocracking reaction conditions include a temperature from about 400° F. to about 900° F., a pressure from about 500 psig to about 2500 psig, a liquid hourly space velocity of the fresh hydrocarbonaceous feedstock from about 0.1 $hr^{-1}$ to about 10 $hr^{-1}$ with a hydrocracking catalyst.

The hydrocracking zone may contain one or more beds of the same or different catalyst. In one embodiment, when the preferred products are middle distillates the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°–1200° F. (371°–648° C.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking conditions which include a temperature from about 450° F. (232° C.) to about 875° F. (468° C.), a pressure from about 500 psig (3448 kPa gauge) to about 3000 psig (20685 kPa gauge), a liquid hourly space velocity (LHSV) from about 0.1 to about 30 $hr^{-1}$, and a hydrogen circulation rate from about 2000 (337 normal $m^3/m^3$) to about 25,000 (4200 normal $m^3/m^3$) standard cubic feet per barrel. In accordance with the present invention, the term "substantial conversion to lower boiling products" is meant to connote the conversion of at least 10 volume percent of the fresh feedstock. The conversion per pass in the hydrocracking zone is preferably in the range from about 10% to about 50% and more preferably in the range from about 20% to about 40%.

The resulting effluent from the hydrocracking reaction zone is transferred without intentional heat-exchange (uncooled) and is introduced into a hot, high pressure stripping zone maintained at essentially the same pressure as the hydrocracking reaction zone where it is countercurrently stripped with a hydrogen-rich gaseous stream to produce a first gaseous hydrocarbonaceous stream containing hydrocarbonaceous compounds boiling at a temperature less than about 700° F., hydrogen sulfide and ammonia, and a first liquid hydrocarbonaceous stream containing hydrocarbonaceous compounds boiling at a temperature greater than about 700° F. The stripping zone is preferably maintained at a temperature in the range from about 450° F. to about 875° F. The effluent from the hydrocracking reaction zone is not substantially cooled and would only be lower in temperature due to unavoidable heat loss during transport from the reaction zone to the stripping zone. It is preferred that the cooling of the hydrocracking reaction zone effluent is less than about 150° F. By maintaining the pressure of the stripping zone at essentially the same pressure as the hydrocracking reaction zone is meant that any difference in pressure is due to the pressure drop required to flow the effluent stream from the reaction zone to the stripping zone. It is preferred that the pressure drop is less than about 150 psig. The hydrogen-rich gaseous stream is preferably supplied to the stripping zone in an amount greater than about 5 weight percent of the hydrocarbonaceous feedstock. The second feedstock is introduced into the upper end of the hot, high pressure stripper to serve as reflux and to be processed further in accordance with the present invention.

At least a portion of the first liquid hydrocarbonaceous stream containing hydrocarbonaceous compounds boiling at a temperature greater than about 700° F. recovered from the stripping zone is in one preferred embodiment recycled to the hydrocracking reaction zone along with added hydrogen.

The resulting first gaseous hydrocarbonaceous stream containing hydrocarbonaceous compounds boiling at a temperature less than about 700° F., hydrogen, hydrogen sulfide and ammonia from the stripping zone is introduced in an all vapor phase into a post-treat hydrogenation reaction zone to hydrogenate at least a portion of the aromatic compounds in order to improve the quality of the middle distillate, particularly the jet fuel. A portion of the first gaseous hydrocarbonaceous stream contains at least a portion of the second feedstock. The post-treat hydrogenation reaction zone may be conducted in a downflow, upflow or radial flow mode of operation and may utilize any known hydrogenation catalyst. The effluent from the post-treat hydrogenation reaction zone is cooled to a temperature in the range from about 40° F. to about 140° F. and at least partially condensed to produce a second liquid hydrocarbonaceous stream which is recovered and fractionated to produce desired hydrocarbon product streams and to produce a second hydrogen-rich gaseous stream which is bifurcated to provide at least a portion of the added hydrogen introduced into the hydrocracking zone as hereinabove described and at least a portion of the first hydrogen-rich gaseous stream introduced in the stripping zone. Fresh make-up hydrogen may be introduced into the process at any suitable and convenient location but is preferably introduced into the stripping zone. Before the second hydrogen-rich gaseous stream is introduced into the hydrocracking zone, it is preferred that at least a significant portion, at least about 90 weight percent, for example, of the hydrogen sulfide is removed and recovered by means of known, conventional methods. In a preferred embodiment, the hydrogen-rich gaseous stream introduced into the hydrocracking zone contains less than about 50 wppm hydrogen sulfide.

In accordance with the present invention, the second feedstock contains hydrocarbons and/or other organic materials and has a boiling range or at least a portion thereof less than the first feedstock. The second feedstock preferably boils in the range from about 300° F. to about 720° F. The second feedstock is introduced into the upper end of the hot, high pressure stripper to serve as reflux. Depending on the boiling range of the second feedstock and the operating conditions of the stripper, at least a portion may be vaporized and subsequently passed directly to the post-treat hydrogenation reaction zone wherein heteroatoms containing sulfur and nitrogen are converted to hydrocarbons thereby producing hydrogen sulfide and ammonia, and aromatic compounds are saturated. The post treat hydrogenation reaction zone produces a hydrocarbon stream having improved product qualities.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

A vacuum gas oil fresh feedstock is introduced into the process via line 1 and is admixed with a hereinafter-described recycle liquid hydrocarbon provided via line 6 and a hydrogen-rich gaseous recycle stream provided via line 29. The resulting admixture is introduced via line 2 into hydrocracking zone 3. A resulting hydrocracked effluent is removed from hydrocracking zone 3 via conduit 4 and is directly introduced into high pressure product stripper 5. A liquid hydrocarbonaceous stream is removed from high pressure product stripper 5 via line 6 and a portion is recycled to hydrocracking zone 3 via line 6 as described hereinabove. Another portion of the bottoms hydrocarbon liquid from high pressure product stripper 5 is removed by line 6 and line 25 and recovered. A second fresh feedstock containing diesel boiling range hydrocarbons is introduced via line 24 at an upper end of high pressure product stripper 5 to serve as reflux and to be processed in the unit. A vapor stream containing hydrocracked hydrocarbon compounds and at least a majority of the second feedstock introduced via line 24 is removed from high pressure product stripper 5 via line 7 and is introduced into post-treat zone 8. A resulting hydrotreated gaseous hydrocarbonaceous stream is removed from post-treat zone 8 via line 9 and is admixed with a wash water stream which is introduced via line 33 and the resulting admixture is introduced into heat-exchanger 10. A resulting cooled and partially condensed stream is removed from heat-exchanger 10 via line 11 and introduced into high pressure separator 12. A spent water stream is removed from high pressure separator 12 via line 34. A liquid hydrocarbonaceous stream is removed from high pressure separator 12 via line 13 and introduced into low pressure separator 14. A normally gaseous hydrocarbonaceous stream is removed from low pressure separator 14 via conduit 15 and recovered. A liquid hydrocarbonaceous product stream is removed from low pressure separator 14 via conduit 16 and recovered. A hydrogen-rich gaseous stream containing hydrogen sulfide is removed from high pressure separator 12 via line 17 and introduced into amine scrubber 18. A lean amine solution is introduced via line 35 into amine scrubber 18 and a rich amine solution is removed therefrom via line 36. A hydrogen-rich gaseous stream containing a reduced concentration of hydrogen sulfide is removed from amine scrubber 18 via line 19 and is admixed with a hydrogen make-up stream provided via line 20. The resulting mixture of hydrogen-rich gas is passed via line 21 and compressed in compressor 22. A portion of the compressed hydrogen-rich gas is removed from compressor 22 and is carried via lines 23 and 29 to provide the hydrogen-rich gaseous recycle stream as hereinabove described. Another portion of the compressed hydrogen-rich gas is removed from compressor 22 via lines 23 and 26 and introduced into heat-exchanger 27. A heated hydrogen-rich gaseous stream is removed from heat-exchanger 27 via line 28 and introduced into a lower portion of high pressure product stripper 5 to serve as a stripping gas and a reactant in post-treat reaction zone 8.

The process of the present invention is further demonstrated by the following illustrative embodiment. This illustrative embodiment is, however, not presented to unduly limit the process of this invention, but to further illustrate the advantages of the hereinabove-described embodiment. The following results were not obtained by the actual performance of the present invention but are considered prospective and reasonably illustrative of the expected performance of the invention based upon sound engineering calculations.

ILLUSTRATIVE EMBODIMENT

A vacuum gas oil feedstock in the amount of 13,800 barrels per stream day (BPSD) and having the characteristics presented in Table 1 is introduced into a hydrocracking zone containing a hydrocracking catalyst and operated at conditions including a pressure of 1600 psig, a temperature of 750° F. and a hydrogen circulation rate of 8000 standard cubic feet per barrel (SCFB). The hydrocracking zone effluent is introduced without cooling into a hot high pressure stripper operated at a pressure of 1550 psig and a temperature of 750° F. A diesel boiling range feedstock in the amount of 8900 BPSD and having the characteristics presented in Table 1 is introduced into an upper end of the hot, high pressure product stripper to serve as reflux and to be upgraded. A hot, hydrogen-rich stripping gas is introduced into the lower end of the stripper in an amount of 7500 SCFB based on the combined feeds. A vapor stream containing hydrocracked hydrocarbon compounds and at least a majority of the diesel feedstock is removed from the high pressure product stripper and introduced into a post-treat zone containing a hydrogenation catalyst selected for its ability to saturate aromatic hydrocarbon compounds and is operated at conditions including a pressure of 1550 psig and a temperature of 660° F. The resulting hydrotreated gaseous hydrocarbonaceous stream is removed from the post-treat zone admixed with a wash water stream and cooled. A resulting cooled and partially condensed stream is separated to recover a spent aqueous stream, a liquid hydrocarbonaceous stream and a hydrogen-rich gaseous stream. The recovered liquid hydrocarbonaceous stream is stabilized and separated to yield a naphtha product in an amount of 2600 BPSD and a diesel product in an amount of 14,600 BPSD and having an API of 35° and a cetane index of 50. A stream of unconverted hydrocarbons in an amount of 6900 BPSD is removed from the bottom of the high pressure product stripper and recycled to the hydrocracking zone. Another stream in an amount of 7000 BPSD and having an API of 280 is removed from the bottom of the high pressure product stripper and subsequently charged to a fluid catalytic cracking zone or otherwise employed.

TABLE 1

FEEDSTOCK ANALYSIS

| | Vacuum Gas Oil | Diesel |
|---|---|---|
| Gravity, ° API | 19.0 | 29.0 |
| Specific Gravity @ 60° F. | 0.940 | 0.8817 |
| Distillation, ° F., (° C.) | | |
| IBP | 631 (333) | 418 (214) |
| 10% | 657 (347) | 485 (262) |
| 50% | 750 (399) | 535 (279) |
| 90% | 931 (498) | 580 (304) |
| EP | 1057 (569) | 665 (352) |
| Sulfur, Weight % | 1.31 | 0.005 |
| Nitrogen, wppm | 386 | <100 |
| Cetane Index | — | 40 |

A comparison of the yield from a prior art process flow scheme in contrast with the process of the present invention is presented in Table 2.

TABLE 2

YIELD COMPARISON

| | Prior Art | Invention |
|---|---|---|
| Naphtha, BPSD | 3300 | 2600 |
| Diesel, BPSD | 13,800 | 14,600 |
| FCC Feed, BPSD | 7,000 | 7,000 |
| TOTAL | 24,100 | 24,200 |

A comparison of the diesel quality from a prior art process flow scheme in contrast with the process of the present invention is presented in Table 3.

TABLE 3

DIESEL QUALITY COMPARISON

| Diesel Properties | Prior Art | Invention |
|---|---|---|
| API Gravity, ° | 32.3 | 35 |
| Boiling Range, ° F. | 380–680 | 380–680 |
| Cetane Index | 45 | 50 |

The data presented in Tables 2 and 3 illustrate the advantages of the present invention, viz., a higher selectivity to the diesel product and a higher cetane index of the diesel product.

The foregoing description, drawing and illustrative embodiment clearly illustrate the advantages encompassed by the process of the present invention and the benefits to be afforded with the use thereof.

What is claimed:

1. A process for the simultaneous hydroprocessing of two feedstocks having different boiling ranges which process comprises:

(a) passing a first hydrocarbonaceous feedstock and hydrogen to a hydrocracking zone containing a hydrocracking catalyst and operating at a temperature of about 400° F. to about 900° F., a pressure from about 500 psig to about 2500 psig, a liquid hourly space velocity from about 0.1 $hr^{-1}$ to about 15 $hr^{-1}$ and recovering a hydrocracking zone effluent therefrom;

(b) passing said hydrocracking zone effluent directly to a hot, high pressure stripper utilizing a hot, hydrogen-rich stripping gas to produce a first vapor stream comprising hydrogen, hydrogen sulfide and hydrocarbonaceous compounds boiling at a temperature below said first hydrocarbonaceous feedstock, and a first liquid stream comprising hydrocarbonaceous compounds boiling in the range of said first hydrocarbonaceous feedstock;

(c) passing a second hydrocarbonaceous feedstock having a boiling temperature range lower than that of said first hydrocarbonaceous feedstock into an upper end of said stripper to serve as reflux;

(d) passing at least a portion of said first vapor stream recovered in step (b) to a post-treat hydrogenation reaction zone to saturate aromatic compounds;

(e) condensing at least a portion of the resulting effluent from said post-treat hydrogenation reaction zone to produce a second liquid stream comprising hydrocarbonaceous compounds boiling at a temperature below said first hydrocarbonaceous feedstock and a second vapor stream comprising hydrogen and hydrogen sulfide; and (f) recycling at least a portion of said second vapor stream to said hydrocracking zone.

2. The process of claim 1 wherein said second vapor stream comprising hydrogen and hydrogen sulfide is treated to remove at least a portion of said hydrogen sulfide.

3. The process of claim 1 wherein said second vapor stream contains less than about 50 wppm hydrogen sulfide.

4. The process of claim 1 wherein said first hydrocarbonaceous feedstock boils in the range from about 600° F. to about 1050° F.

5. The process of claim 1 wherein said second hydrocarbonaceous feedstock boils in the range from about 300° F. to about 720° F.

6. The process of claim 1 wherein said hot, high pressure stripper is operated at a temperature and pressure which is essentially equal to that of said hydrocracking zone.

7. The process of claim 1 wherein said hot, high pressure stripper is operated at a temperature no less than about 150° F. below the outlet temperature of said hydrocracking zone and at a pressure no less than about 150 psig below the outlet pressure of said hydrocracking zone.

8. The process of claim 1 wherein said hydrocracking zone is operated at a conversion per pass in the range from about 10% to about 50%.

9. The process of claim 1 wherein said hydrocracking zone is operated at a conversion per pass in the range from about 20% to about 40%.

10. The process of claim 1 wherein at least a portion of said first liquid stream is recycled to said hydrocracking zone.

11. The process of claim 1 wherein said post-treat hydrogenation reaction zone is operated at reaction zone conditions including a temperature from about 400° F. to about 900° F. and a pressure from about 500 psig to about 2500 psig.

12. A process for the simultaneous hydroprocessing of two feedstocks having different boiling ranges which process comprises:

(a) passing a first hydrocarbonaceous feedstock and hydrogen to a hydrocracking zone containing a hydrocracking catalyst and operating at a temperature of about 400° F. to about 900° F., a pressure from about 500 psig to about 2500 psig, a liquid hourly space velocity from about 0.1 $hr^{-1}$ to about 15 $hr^{-1}$ and recovering a hydrocracking zone effluent therefrom;

(b) passing said hydrocracking zone effluent directly to a hot, high pressure stripper utilizing a hot, hydrogen-rich stripping gas to produce a first vapor stream comprising hydrogen, hydrogen sulfide and hydrocarbonaceous compounds boiling at a temperature below said first hydrocarbonaceous feedstock, and a first liquid stream comprising hydrocarbonaceous compounds boiling in the range of said first hydrocarbonaceous feedstock;

(c) passing a second hydrocarbonaceous feedstock having a boiling temperature range lower than that of said first hydrocarbonaceous feedstock into an upper end of said stripper to serve as reflux;

(d) passing at least a portion of said first vapor stream recovered in step (b) to a post-treat hydrogenation reaction zone to saturate aromatic compounds;

(e) condensing at least a portion of the resulting effluent from said post-treat hydrogenation reaction zone to produce a second liquid stream comprising hydrocarbonaceous compounds boiling at a temperature below said first hydrocarbonaceous feedstock and a second vapor stream comprising hydrogen and hydrogen sulfide;

(f) recycling at least a portion of said second vapor stream to said hydrocracking zone; and (g) recycling at least a portion of said first liquid stream to said hydrocracking zone.

13. The process of claim 12 wherein said second vapor stream comprising hydrogen and hydrogen sulfide is treated to remove at least a portion of said hydrogen sulfide.

14. The process of claim 12 wherein said second vapor stream contains less than about 50 wppm hydrogen sulfide.

15. The process of claim 12 wherein said first hydrocarbonaceous feedstock boils in the range from about 600° F. to about 1050° F.

16. The process of claim 12 wherein said second hydrocarbonaceous feedstock boils in the range from about 300° F. to about 720° F.

17. The process of claim 12 wherein said hot, high pressure stripper is operated at a temperature and pressure which is essentially equal to that of said hydrocracking zone.

18. The process of claim 12 wherein said hot, high pressure stripper is operated at a temperature no less than about 150° F. below the outlet temperature of said hydrocracking zone and at a pressure no less than about 150 psig below the outlet pressure of said hydrocracking zone.

19. The process of claim 12 wherein said hydrocracking zone is operated at a conversion per pass in the range from about 10% to about 50%.

20. The process of claim 12 wherein said hydrocracking zone is operated at a conversion per pass in the range from about 20% to about 40%.

21. The process of claim 12 wherein said post-treat hydrogenation reaction zone is operated at reaction zone conditions including a temperature from about 400° F. to about 900° F. and a pressure from about 500 psig to about 2500 psig.

* * * * *